United States Patent [19]

Habeeb

[11] 4,329,222

[45] May 11, 1982

[54] METHOD FOR SELECTIVELY REMOVING BASIC NITROGEN COMPOUNDS FROM LUBE OILS USING TRANSITION METAL HALIDES OR TRANSITION METAL TETRAFLUOROBORATES

[75] Inventor: Jacob J. Habeeb, Sarnia, Canada

[73] Assignee: Exxon Research & Engineering Co., Florham Park, N.J.

[21] Appl. No.: 191,078

[22] Filed: Sep. 26, 1980

[51] Int. Cl.[3] ..... C10G 17/00; C10G 25/02; C10G 29/12; C07C 7/12

[52] U.S. Cl. ..... 208/254 R; 585/864

[58] Field of Search ..... 208/254 R; 585/864

[56] References Cited

U.S. PATENT DOCUMENTS

| | | | |
|---|---|---|---|
| 2,796,387 | 6/1957 | Schmidt | 208/254 R |
| 2,970,105 | 1/1961 | Condo et al. | 208/254 R |
| 3,055,825 | 9/1962 | Buningh et al. | 208/254 R |
| 3,193,496 | 7/1965 | Hartung | 208/254 R |
| 3,326,798 | 6/1967 | Hess | 208/254 R |
| 4,071,435 | 1/1978 | Smith | 208/254 R |

OTHER PUBLICATIONS

Habeeb, et al., "Electrochemical Preparation of Anhydrous Halides of Transition Metals," Inorganic Chemistry 17 (2), 306–310 (1978).

Rebenstorf, "Preparation and Reactions of a Coordinatively Unsaturated Surface Compound of Iron (II) on Silica Gel," Acta Chem. Scand. A31, 547–550 (1977).

Turov et al., "Nitrous Bases of the 140°–240° C. Fraction of Western Siberian Oils," Neftekhimiia, 17 (5), 796–801 (1977).

Delert et al., "Concerning the Separation of Neutral Compounds from Petroleum and Coal Products", Deutsche ges Mineral und Kohlechimie e.v., Compendium, Part 2, 968–977 (1976–1977).

*Primary Examiner*—Delbert E. Gantz
*Assistant Examiner*—Olik Chaudhuri
*Attorney, Agent, or Firm*—Joseph J. Allocca

[57] ABSTRACT

A method is disclosed for the selective removal of basic nitrogen compounds (BNC) from natural and synthetic hydrocarbon feedstocks, preferably petroleum feedstocks, most preferably lube and transformer oils, which method comprises mixing the feedstock oil with a nonaqueous solution of anhydrous nonpolymeric Group IVb, Group Vb, Group VIb, Group VIIb, the nonnoble (iron group) metals of Group VIII, copper, zinc, cadmium, and mercury halides (except $TiCl_4$ or $FeCl_3$) or tetrafluoroborates, complexed with non-aqueous polar solvents under conditions of agitation and mild heating whereby the basic nitrogen compounds exchange with the polar solvent to complex with the above-recited metal halides and metal tetrafluoroborates. The preferred halide is bromide, and the preferred polar solvent is methanol. The oil is then decanted to separate it from the metal halides: BNC complexes and the decantate washed with a polar solvent, which preferably includes water, and dried. The basic nitrogen compound-metal halide or metal tetrafluoroborate complex dissolves in the polar solvent, and that which is in the oil is removed by the polar solvent wash. The preferred polar solvent for the wash step is water. By the practice of this method, the basic nitrogen compound content of the oil is reduced by at least 90%.

The anhydrous nonpolymeric metal halide or metal tetrafluoroborate-nonaqueous polar solvent complex can be used as such, or they can be impregnated onto a support material.

21 Claims, No Drawings

METHOD FOR SELECTIVELY REMOVING BASIC NITROGEN COMPOUNDS FROM LUBE OILS USING TRANSITION METAL HALIDES OR TRANSITION METAL TETRAFLUOROBORATES

DESCRIPTION OF THE INVENTION

A method is disclosed for the selective removal of basic nitrogen compounds (BNC) from natural and synthetic hydrocarbon feedstocks, preferably petroleum feedstocks, most preferably lube and transformer oils, which method comprises mixing the feedstock oil with a nonaqueous solution of anhydrous nonpolymeric Group IVb, Group Vb, Group VIb, Group VIIb, the non-noble (iron group) metals of Group VIII, copper, zinc, cadmium and mercury halides (except $TiCl_4$ or $FeCl_3$) or tetrafluoroborates, complexed with nonaqueous polar solvents under conditions of mild agitation and heating whereby the basic nitrogen compounds exchange with the polar solvent to complex with the above-recited metal halides or metal tetrafluoroborates. The preferred halide is bromide, and the preferred polar solvent is methanol. The oil is then decanted to separate it from the metal halides:BNC complexes and the decantate washed with a polar solvent, which preferably includes water, and dried. The basic nitrogen compound-metal halide or metal tetrafluoroborate complex dissolves in the polar solvent, and that which is in the oil is removed by the polar solvent wash. The preferred polar solvent for the wash step is water. By the practice of this method, the basic nitrogen compound content of the oil is reduced by at least 90%.

The anhydrous nonpolymeric metal halide or metal tetrafluoroborate-nonaqueous polar solvent complex can be used as such, or they can be impregnated onto a support material such as silica, alumina, silica-alumina, faujasite, kaolin, carbon, zeolite, coal, vermiculite, etc., and used as supported basic nitrogen compound complexation compositions. These supported materials can be regenerated after use by washing with polar solvents. They recover essentially all of their complexation ability.

The reaction can be described in terms of the following formula:

$$MX_nQ_z + BNC_\Delta \rightarrow MX_n(BNC)_z + zQ \quad (I)$$

wherein M is the metal component selected from the group consisting of iron, cobalt, titanium, molybdenum, Group IVb, Group Vb, Group VIb, Group VIIb, the non-noble (iron group) of Group VIII, copper, zinc, cadmium, mercury; X is a halide selected from the group consisting of chloride, bromide, iodide, or is tetrafluoroborate except that when M is titanium or iron, X cannot be chlorine; n is the number of X atoms satisfying the valence requirements of the metal at the oxidation state employed; Q is the complexed nonaqueous polar solvent; z is the number of nonaqueous polar solvent molecules and BNC is basic nitrogen compounds.

The metal M is preferably selected from the group consisting of nickel, chromium, vanadium, zinc, copper, manganese, iron, cobalt, titanium, molybdenum, cadmium, and mercury. The preferred halide is bromide. The most preferred metal bromides are chromium tribromide, nickel dibromide, vanadium dibromide, zinc dibromide, and the copper, manganese, iron and cobalt bromides. These metal bromides are preferably complexed with a nonaqueous polar solvent selected from the group consisting of methanol, ethanol, acetone, acetonitrile, most preferably methanol.

Any oil which can be benefited by the removal of basic nitrogen compounds can be treated by the method of the instant invention. Natural and synthetic hydrocarbon feedstocks, such as those derived from coal, tar sands or oil shale, etc., can thus be processed. Typical of feedstocks which are processed are the petroleum oils destined for use as lubricating or transformer oils wherein the presence of basic nitrogen compounds is known to be a major cause of reduced oxidative stability. These oils need not be pretreated prior to this BNC removal process, since the process functions effectively in the presence of a broad spectrum of contaminants, including, for example, and not by way of limitation, N-methyl pyrrolidone, acids, ionic species, phenols, sulfates, etc. Polar compounds, other than BNC, also contribute to the oxidative instability of the oils and these too can be removed by use of the metal solution complexes wherein the polar compounds complex to the metal halides or metal tetrafluoroborates.

These is no limit on the amount of basic nitrogen compounds which can be efficiently removed by the instant process. Any quantity can be removed provided an effective concentration of metal halide or metal tetrafluoroborate material is employed. Determination of what constitutes an effective concentration of material is readily achieved by reference to Formula I above once the metal and its oxidation state are substituted into the formula. Depending upon the metal selected and its oxidation state as used, from 2 to 6 basic nitrogen compound molecules can be removed by complexation to one metal halide or metal tetrafluoroborate molecule. Preferably, a stoichiometric amount of metal halide or metal tetrafluoroborate (as determined by the metal oxidation state) is employed.

As previously stated, the metal halide or metal tetrafluoroborate is employed in this process in the form of a complex with a nonaqueous polar solvent. The concentration of metal halide or metal tetrafluoroborate, which may be effectively employed in the chosen solvent depends upon the choice of metal and is limited solely by the solubility of the metal halide or metal tetrafluoroborate in the solvent. Typically, this ranges anywhere from about 0.1 gram material or less per milliliter solvent to 1.0 gram material or more per milliliter solvent. Higher concentrations of metal materials or greater volumes of complex solution are employed for oils more highly contaminated with basic nitrogen compounds.

The oils and metal solution complexes are mixed so as to obtain high surface contact between the oils and the metal solution complexes. This is typically achieved by mixing under conditions of agitation so as to insure complete mixing of the components and the resultant exchange of BNC with the polar solvent on the metal halide or metal tetrafluoroborate. This agitation can be achieved by any of a variety of standard methods including mechanical stirring and bubbling gases, preferably inert gases such as $N_2$ through the oil-metal solution complex combination.

These oil-metal solution complex combinations are subjected to mild heating on the order of a temperature between about 25° to 120° C., preferably 50° to 100° C., most preferably 50°–80° C. This heating is employed so as to facilitate the exchange of the BNC for the polar solvent in the metal halide or metal tetrafluoroborate as shown in Formula I.

The oil and metal solution complex are mixed and heated for a time sufficient to insure substantially complete exchange of the BNC and the polar solvent moiety. The oil is then decanted. The decantate is washed with polar solvent or water to remove any metal halide or metal tetrafluoroborate-BNC complex remaining in the oil. These complexes are soluble in the polar solvent or water. The wash solvent may be employed at any convenient temperature, preferably between 0°-20° C. The volume of wash solvent is also, any convenient volume, typically 1-5 volumes wash solvent per volume decantate.

The oil is dried under any convenient condition. The oil is found to have had its basic nitrogen compound content reduced by at least 90% by the practice of the instant process.

It must be noted that when the metal halide or metal tetrafluoroborate materials complexed with the polar solvents are described, they are identified as being anhydrous, nonpolymeric materials; and the polar solvent is identified as being any polar solvent except water. Polymeric materials are to be avoided since their exchangeable sites are very limited and difficult to gain access to. Further, polymeric metal halides are relatively insoluble in the solvents employed in the instant invention. Similarly, the presence of water at the exchange site in place of other polar solvents is to be avoided since water is exchanged only with extreme difficulty and only at temperatures high enough to adversely effect the quality of the oil and/or decompose the metal halide (see Table 7).

The anhydrous, nonpolymeric metal halides used in the instant invention are prepared by the electrochemical technique explained in detail in "Electrochemical Preparation of Anhydrous Halides of Transition Metals (Mn-Zn)," by J. J. Habeeb, L. Neilson and D. G. Tuck, *Inorganic Chemistry* 17(2), 306 (1978).

Essentially, the anhydrous, nonpolymeric metal halides are prepared by preparing a solution of nonaqueous polar solvent and halogen, immersing a cathode of a material such as platinum, and an anode made of the desired metal in the solution and applying a current. The reaction is typically carried out under an inert atmosphere such as nitrogen. After the reaction is stopped, the excess halogen is vented. Metal halide-polar solvent complexes are quite stable if stored under inert atmospheres.

The anhydrous, nonpolymeric metal halide and metal tetrafluoroborate-polar solvent complexes can be employed as such in the instant process, or they can be deposited on a suitable inorganic refractory oxide or carbonaceous support and used as a regenerable supported BNC complexation material. Typical support materials include silica, alumina, natural and synthetic zeolites, carbon, faujasite, callcite, coal, etc.; preferably silica, alumina, and zeolites; most preferably silica and alumina. These supported complexes are prepared by mixing the chosen support with a volume of metal halide or metal tetrafluoroborate-nonaqueous polar solvent complex, heating the combination at from 50° to 100° C. under an inert atmosphere, followed by drying at from 75° to 125° C. The heating and drying steps can be accomplished as a single step. Care is taken not to drive off the complexed polar solvent molecules. The dried combination is cooled, preferably in an inert atmosphere or under vacuum. The combination metal loading is not critical but will have a typical metal loading range of from 0.5 to 10% metal. Again, the higher the concentration, the more BNC can be removed employing a given volume of supported complex.

When these supported materials are used, the oil is contacted with them as by pouring and the BNC are removed by exchange with the nonaqueous polar solvent complexed with the metal halide or metal tetrafluoroborate.

After the theoretical maximum volume of oil has been passed through the supported complex, oil passage is terminated; and the support complex regenerated by washing with acetone or any polar solvent (except water) at temperatures between about 25° to 75° C., preferably about 50° C. Supported complexes which are thus regenerated recover essentially all of their ability to remove BNC.

The following Examples are presented so as to help describe the invention and are not presented by way of limitation.

EXAMPLES

Example 1

Removal of Compounds Containing Basic Nitrogen from Lube Oils by Chromium Tribromide 150 g of a refined transformer oil containing 46 ppm basic nitrogen was mixed with 8 g of methanol containing approximately 300 mg of chromium tribromide. The solution mixture was heated at 75° C. for 15 minutes with nitrogen gas bubbling (or stirring) at a rate of 50 cc/minute to ensure complete mixing. The oil sample was then decanted. The decantate was washed with cold water and dried by heating to 105° C. with a nitrogen flow of 250 cc/minute. The chromium complex had been extracted into the water layer.

The dried decanted oil had a basic nitrogen content of less than 4 ppm, a reduction of more than 90%. The benefit of removing these basic nitrogen components with $CrBr_3$ is shown by the fact that the Rotary Bomb Life (ASTM D2112) with 0.06 wt. % 2,6-ditertiarybutyl-para-cresol increased from 179 minutes for the untreated oil to 282 minutes for the treated oil.

Example 2

Removal of Compounds Containing Basic Nitrogen From Lube Oils by Nickel Dibromide 175 g of oil was mixed with 10 ml of methanol containing 300 mg of nickel dibromide. The solution mixture was heated to 80° C. for 15 minutes with stirring and nitrogen gas bubbling at a rate of 100 cc/minute. The oil sample was then decanted. The decantate was washed with cold water and dried by heating to 120° C. with nitrogen flow of 300 cc/minute. The nickel complex, a yellow solid, was collected and washed for identification. The degree of basic nitrogen compound removal is presented in Table 1.

TABLE 1

| | Basic Nitrogen in ppm | |
|---|---|---|
| Oil | Before Treatment | After Treatment |
| 60 Neutral | 46 | 3 |
| 600 Neutral | 81 | 9 |
| Light Raw Distillate | 111 | 6 |

Example 3

Removal of Compounds Containing Basic Nitrogen from Lube Oils by Methanolated Vanadium Dibromide 175 g of oil was mixed with 15 ml of methanol containing 300 mg of vanadium dibromide. The solution mixture was heated to 80° C. for 15 minutes with stirring and nitrogen gas bubbling at a rate of 100 cc/minute. The oil sample was then decanted. The decantate was washed with cold water and dried by heating to 170° C. with nitrogen flow of 400 cc/min. The vanadium complex, a thick dark brown solid, was treated with water to obtain pure basic nitrogen containing compounds for further investigations. The degree of basic nitrogen compound removal is presented in Table 2.

TABLE 2

| Oil | Basic Nitrogen in ppm Before Treatment | After Treatment |
|---|---|---|
| 60 Neutral | 46 | 3 |
| 600 Neutral | 81 | 7 |
| Light Raw Distillate | 111 | 1 |

The basic process essentially is the injection of vanadium bromide—methanol solution into oil followed by decantation of the oil and then water washing to remove the vanadium bromide complexes of basic nitrogen compounds. The process could also be applied to upgrade heavy crudes.

Example 4

Removal of Compounds Containing Basic Nitrogen from Lube Oils by Zinc Dibromide and Copper Bromides Zinc dibromide in methanol and copper bromides (a mixture of Cu(I) and Cu(II) bromides) in methanol are powerful agents for the removal of these basic nitrogen compounds from a wide variety of lube oils—namely, 60 neutrals, 600 neutrals and raw distillates—by forming water soluble complexes of zinc dibromide and copper bromides.

In a typical experiment, 175 g of oil was mixed with 5-fold excess of metal bromides in methanol to basic nitrogen compounds. The solution mixture was heated to 80° C. for 10 minutes with stirring and nitrogen gas bubbling at a rate of 200 cc/minute. The oil sample was then decanted. The decantate was washed with warm water (60° C.) and dried by heating to 120° C. with nitrogen flow of 700 cc/minute. The metal complexes, either as thick dark brown oil stuck to the walls of the reaction vessel or as brown solid. In both cases, metal complexes were collected for identification. The degree of basic nitrogen compound removal is presented in Table 3.

TABLE 3

| Oil | Basic Nitrogen Content of Oils in ppm Before Treatment | Treated With $ZnBr_2$ | Treated With Copper Bromides |
|---|---|---|---|
| 60 Neutral | 46 | 1 | 4 |
| 600 Neutral | 81 | 3 | 6 |
| Light Raw Distillate | 111 | 1 | 9 |

The benefit of removing basic nitrogen components with $ZnBr_2$ is shown by the fact that the Rotary Bomb Life (ASTM D2112) with 0.06 wt. % 2,6-ditertiarybutyl-para-cresol increased from 179 minutes for the untreated 60 neutral oil to 263 minutes for the treated oil and with 0.3 wt. % 2,6-ditertiarybutyl-para-cresol increased from 49 minutes for the untreated light Raw Distillates to 173 minutes for the treated oil.

The basic process for $ZnBr_2$ and copper bromide treating is envisaged to be injection of the metal bromide-methanol solution into the oil followed by water washing to remove metal bromide basic nitrogen complexes.

Example 5

Removal of Compounds Containing Basic Nitrogen from Lube Oils by Manganese, Iron, and Cobalt Bromides In a typical experiment, 200 g of oil was mixed with a 5-fold excess of a metal bromide in methanol relative to basic nitrogen compound content. The mixture was heated to 80° C. for 10 minutes with stirring and nitrogen gas bubbling at a rate of 200 cc/minute. The oil was then decanted. The decantate was washed with warm water (60° C.) and dried by heating to 120° C. with nitrogen flow of 700 cc/minute. The metal complexes, thick, dark brown (green in the case of cobalt bromide) oils stuck to the walls of the reaction vessel, were collected for identification. The degree of basic nitrogen compound removal is presented in Table 4.

TABLE 4

| Oil | Basic Nitrogen Content of Oils in ppm Before Treatment | Treated With $MnBr_2$ | Treated With $FeBr_2$ | Treated With $CoBr_2$ |
|---|---|---|---|---|
| 60 Neutral | 46 | 3 | 4 | 1 |
| 600 Neutral | 81 | 6 | 3 | 2 |
| Light Raw Distillate | 111 | 2 | 7 | 3 |

Example 6

Methanolated Transition Metal Tetrafluoroborates are Basic Nitrogen Scavengers

In a typical experiment, 200 g of oil is mixed with 5-fold excess of metal tetrafluoroborate in methanol relative to basic nitrogen compounds. The solution mixture was heated to 80° C. for 10 minutes with stirring and nitrogen gas bubbling at a rate of 250 cc/minute. The oil sample was decanted and then filtered. The metal complexes, a thick, dark brown oil, were stuck to the walls of the reaction vessel. The degree to basic nitrogen compound removal is presented in Table 5.

TABLE 5

| Oil | Basic Nitrogen Content of Oils in ppm Before Treatment | After Treatment |
|---|---|---|
| 100 Neutral | 25 | 1 |
| Light Raw Distillate | 110 | 4 |

Example 7

Removal of Compounds Containing Basic Nitrogen from Lube Oils by Silica Gel Impregnated with Ti(III), V(II), Cr(III), Mo(II), Mn(II), Fe(II), Co(II), Ni(II), Cu(II) and Zn(II) Bromides Preparation of the impregnated silica gel was performed as follows. Methanolated complexes of the mentioned transition metal bromides were prepared by electrolysis. Samples of these complexes containing 1 to 3 g of metal were mixed with silica gel (different grades) and heated to 70° C. under nitrogen followed by drying at 100° C. The new absorbent was cooled in vacuum.

In a typical experiment, a 20 cm long and 2.5 cm diameter column was packed with 75 g impregnated silica gel. An unimpregnated silica gel column of the same dimensions was also used for comparison. Oil was poured through each of the columns which were kept at 80°-90° C. The columns need not be maintained at these high temperatures, effective operation being achieved at lower temperatures. Higher temperatures were used to facilitate the rate of flow of high viscosity oils through the column.

Silica gel impregnated with the above-mentioned transition metal bromides are regenerated by washing with acetone at 50° C. after oil has been recovered. The degree of basic nitrogen compound removal is presented in Table 6.

TABLE 6

| | | | | | | | |
|---|---|---|---|---|---|---|---|
| Column (I) | | | | | | | |
| Silica Gel (Blank) | | | | | | | |
| No. of ml of oil | 50 | 100 | 150 | 200 | 300 | 400 | 500 |
| Basic nitrogen (ppm) in Recovered Oil | <2 | <2 | −5 | 14 | 16 | 21 | 25 |
| Column (II) | | | | | | | |
| Impregnated Silica Gel with $CrBr_3$ | | | | | | | |
| No. of ml of oil | 250 | 500 | 1000 | 2000 | 3000 | 4000 | |
| Basic nitrogen (ppm) in Recovered Oil | <1 | <1 | <1 | <2 | <2 | <2 | |
| Column (III): Column (II) - Regenerated | | | | | | | |
| No. of ml of oil | 100 | 400 | 600 | 800 | 1200 | 1500 | |
| Basic nitrogen (ppm) in Recovered Oil | <2 | <2 | <2 | <2 | 2 | 2 | |

Similar results may be obtained using the other metal bromide complexes. The benefit of removing basic nitrogen components by this method is shown by the fact that Rotary Bomb Life (ASTM D2112) with 0.3 wt.% 2,6-ditertiarybutyl-para-cresol increased from 49 minutes for the untreated light Raw Distillates (110 ppm BNC) to 238 minutes after treatment (2 ppm BNC).

This method has an excellent potential in lube oil processing due to the fact that impregnated silica gel beds can be efficiently regenerated and reused for an indefinite number of cycles.

Example 8

In a typical experiment, 200 g of oil (60 neutral containing 46 ppm BNC) was mixed with 400 mg $TiCl_4$ in methanol. The mixture was heated to 80° C. for 10 minutes with stirring and nitrogen gas bubbling at a rate of 200 cc/minute. The oil was decanted. The decantate was washed with warm water (60° C.) and dried by heating to 120° C. with nitrogen gas flow of 700 cc/minute. BNC concentration before treatment was 46 ppm while after treatment BNC concentration was 7 ppm. However, the Rotary Bomb Life (ASTM D2112) with 0.06 wt.% 2,6-ditertiarybutyl-para-cresol decreased from 200 minutes before treatment to 86 minutes after treatment indicating that $TiCl_4$, although removing BNC from oils, has deleterious effect on the treated oil. This may be due to the easy reduction of $TiCl_4$ to $TiCl_3$ and the production of the highly reactive chlorine atom which acts as strong oxidizing agent in addition to Ti(iv) which is an oxidizing agent when it reduces to Ti(iii).

Elemental sulphur concentration was decreased from 0.24 wt.% before treatment to 0.1 wt.% after treatment. This indicates that $TiCl_4$ is non-selective coordinating compound. Removal of naturally occurring antioxidant sulphur compounds will also have a detrimental effect on oil.

On treating the oil with $FeCl_3$ using exactly the same quantities of materials and procedure, similar results were observed.

| Before Treatment | | | After Treatment ($FeCl_3$) | | |
|---|---|---|---|---|---|
| BNC | S % | RBOT min | BNC | S % | RBOT min |
| 46 | 0.24 | 200 | 5 | 0.12 | 132 |

Example 9

In a typical experiment, 175 g of oil was mixed with 5-fold excess of metal bromides in water relative to basic nitrogen compounds content. The mixture was heated to (75°-80° C.) for 10 minutes with stirring and nitrogen gas bubbling at a rate of 200 cc/minute. The oil was decanted. The decantate was washed with warm water (60° C.) and dried by heating to 120° C. with nitrogen flow of 700 cc/minutes. Results are summarized in Table 7 which shows that whereas BNC content dramatically decreases when using a nonaqueous solvent, only minimal reduction in BNC content is achieved when using water as the solvent.

TABLE 7

| | | Before Treatment | | After Treatment | | Metal Complex | |
|---|---|---|---|---|---|---|---|
| Example | Oil | BN(ppm) | S % | BN(ppm) | S % | (Solvent) | Temperature |
| 1 | 60N | 46 | 0.24 | 4 | 0.24 | $CrBr_3$ (Methanol) | 75° C. |
| 2 | 60N | 46 | 0.24 | 3 | 0.24 | $NiBr_3$ (Methanol) | 80° C. |
| 1 | 60N | 17.5 | 0.21 | 1.0 | 0.21 | $CrBr_3$ (Methanol) | 75-80° C. |
| 5 | 600N | 81 | 0.6 | 6.0 | 0.6 | $MnBr_2$ (Methanol) | 80° C. |
| 4 | 600N | 81 | 0.6 | 3 | 0.6 | $ZnBr_2$ (Methanol) | 80° C. |
| 6 | 100N | 21 | 0.33 | ~2 | 0.33 | $Zn(BF_4)_2$ (Methanol) | 80° C. |
| 6 | Hydrofined Light Raw Distillate | 103 | 0.29 | ~2 | 0.29 | $Zn(BF_4)_2$ (Methanol) | 75-80° C. |
| 1 | Hydrofined Light Raw | 103 | 0.29 | ~3 | — | $CrBr_3$ (Methanol) | 75-80° C. |

TABLE 7-continued

| Example | Oil | Before Treatment BN(ppm) | Before Treatment S % | After Treatment BN(ppm) | After Treatment S % | Metal Complex (Solvent) | Temperature |
|---|---|---|---|---|---|---|---|
| | Distillate | | | | | | |
| 9 | 60N | 46 | 0.24 | 34 | — | $CrBr_3$ ($H_2O$) | 75–80° C. |
| 9 | 60N | 46 | 0.24 | 29 | — | $FeBr_2$ ($H_2O$) | 75–80° C. |
| 9 | Hydrofined LRD | 103 | 0.29 | 81 | — | $CrBr_3$ ($H_2O$) | 75–80° C. |
| 9 | 60N | 46 | 0.24 | 21 | — | $CrBr_3$ ($H_2O$) | 140–145° C. |

What is claimed is:

1. A method for selectively removing basic nitrogen compounds (BNC) from natural and synthetic hydrocarbon feedstocks comprising mixing the feedstock under conditions of agitation and mild heating with anhydrous nonpolymeric Group IVB, Group VB, Group VIB, Group VIIB, the non-noble Group VIII, copper, zinc, cadmium and mercury halides, except that the halide may not be chlorine, which metal halides are complexed with nonaqueous polar solvent and wherein the metal halide-nonaqueous polar solvent complex is impregnated onto a support material, whereby the BNC exchange with the complexed nonaqueous polar solvents and themselves become complexed with the metal halides of the supported metal halide-nonaqueous polar solvent complex.

2. The method of claim 1 further comprising the step of separating the feedstock from which the basic nitrogen compounds have been removed from the supported metal halide nonaqueous polar solvent complex with which the basic nitrogen compounds are now complexed by their exchange with the polar solvent, washing the separated feedstock with polar solvent and drying.

3. The method of claim 1 or 2 wherein the metal halide is a metal bromide.

4. The method of claim 1 or 2 wherein the polar solvent which is complexed with the metal halide is methanol.

5. The method of claim 3 wherein the polar solvent which is complexed with the metal bromide is methanol.

6. The method of claim 1 or 2 wherein the metal is selected from the group consisting of nickel, chromium, vanadium, zinc, copper, manganese, iron, cobalt, titanium, molybdenum, cadmium and mercury.

7. The method of claim 3 wherein the metal bromide is selected from the group consisting of chromium tribromide, nickel dibromide, vanadium dibromide, zinc dibromide and the copper, manganese, iron and cobalt bromides.

8. The method of claim 1 or 2 wherein the nonaqueous polar solvent with which the metal halide is complexed is selected from the group consisting of methanol, ethanol, acetone and acetonitrile.

9. The method of claim 1 or 2 wherein the mild heating is conducted at a temperature ranging from between about 25° to 120° C.

10. The method of claim 2 wherein the polar solvent wash employs water as the polar solvent.

11. The method of claim 1 wherein the supported metal halide nonaqueous polar solvent complex is regenerated after use by washing with nonaqueous polar solvent at temperatures between about 25° to 75° C.

12. The method of claim 2 wherein the supported metal halide nonaqueous polar solvent complex is regenerated after use by washing with nonaqueous polar solvent at temperatures between about 25° to 75° C.

13. A method for selectively removing basic nitrogen compounds (BNC) from natural and synthetic hydrocarbon feedstocks comprising mixing the feedstock under conditions of agitation and mild heating with anhydrous nonpolymeric Group IVb, Group Vb, Group VIb, Group VIIb, the non-noble Group VIII, copper, zinc, cadmium and mercury tetrafluoroborates which metal tetrafluoroborates are complexed with nonaqueous polar solvents whereby the BNC exchange with the complexed nonaqueous polar solvents and themselves become complexed with the metal tetrafluoroborates.

14. The method of claim 13 further comprising the step of separating the feedstock from which the basic nitrogen compounds have been removed from the metal tetrafluoroborate-nonaqueous polar solvent complex with which the basic nitrogen compounds are now complexed by their exchange with the polar solvent, washing the separated feedstock with polar solvent and drying.

15. The method of claim 13 or 14 wherein the nonaqueous polar solvent which is complexed with the metal tetrafluoroborate is methanol.

16. The method of claim 13 or 14 wherein the metal tetrafluoroborate-nonaqueous polar solvent is impregnated onto a support material.

17. The method of claim 13 or 14 wherein the metal is selected from the group consisting of nickel, chromium, vanadium, zinc, copper, manganese, iron, cobalt, titanium, molybdenum, cadmium and mercury.

18. The method of claim 13 or 14 wherein the nonaqueous polar solvent with which the metal tetrafluoroborate is complexed is selected from the group consisting of methanol, ethanol, acetone and acetonitrile.

19. The method of claim 13 or 14 wherein the mild heating is conducted at a temperature ranging from between about 25° to 120° C.

20. The method of claim 14 wherein the polar solvent wash employs water as the polar solvent.

21. The method of claim 16 wherein the supported metal tetrafluoroborate-nonaqueous polar solvent complex is regenerated after use by washing with nonaqueous polar solvent at temperatures between about 25° to 75° C.

* * * * *